US005778643A

United States Patent [19]

Tacchini

[11] Patent Number: 5,778,643

[45] Date of Patent: Jul. 14, 1998

[54] DEVICE TO CONTROL THE FEEDING OF THE STRAP IN A STRAPPING MACHINE

[75] Inventor: Franco Tacchini, Nebbiuno, Italy

[73] Assignee: Officina Meccanica Sestese S.p.A., Paruzzaro, Italy

[21] Appl. No.: 816,419

[22] Filed: Mar. 14, 1997

[51] Int. Cl.[6] ..... B65B 13/04

[52] U.S. Cl. ..... 53/589; 53/582; 53/26; 53/32; 53/4

[58] Field of Search ..... 53/589, 582; 100/26, 100/29, 32, 4

[56] References Cited

U.S. PATENT DOCUMENTS

| | | | |
|---|---|---|---|
| 3,526,187 | 9/1970 | Gilliard . | |
| 4,516,488 | 5/1985 | Bartzick et al. | 53/589 X |
| 4,559,767 | 12/1985 | Takami | 53/589 |
| 5,078,058 | 1/1992 | Schwede et al. | 53/589 X |
| 5,155,982 | 10/1992 | Boek et al. . | |
| 5,379,576 | 1/1995 | Koyama . | |
| 5,459,977 | 10/1995 | Haberstroh | 53/589 X |

*Primary Examiner*—Linda Johnson
*Attorney, Agent, or Firm*—Young & Thompson

[57] ABSTRACT

Device to control the feeding of the strap in a strapping machine, comprising at least one fast driving wheel (4) and one slow driving wheel (2) which are mounted on fixed axes, the strap (R) being guided on the periphery of both driving wheels, and wherein pressure elements (5 and 14) are provided to press the strap (R) against the periphery of one and/or the other of the driving wheels, so as to ensure feeding thereof. The pressure elements are mounted on an oscillating sector (8) which is operated in response to tensioning of the strap. On the oscillating sector (8) there is also mounted a strap transmission wheel (13), located at a distance from the pressure elements, which imparts on the oscillating sector (8), according to the tension of the strap (R), an oscillation such as to transfer the contact pressure of the strap from the fast driving wheel (4)—for the fast recovery step—onto the slow driving wheel (2)—for the slow tightening step—merely through the alternative action of the pressure elements.

11 Claims, 5 Drawing Sheets

DEVICE TO CONTROL THE FEEDING OF THE STRAP IN A STRAPPING MACHINE

BACKGROUND OF THE INVENTION

1. Field of the Invention

The present invention concerns a strapping machine and, more particularly, a device to control the feeding of the strap, allowing a more precise and rapid control of the strap stopping or speed-changing function during its recovery, that is, closing and tightening of the strap around the packed product to be fastened.

As known, machines of this type comprise drive means which draw the strap from a reel, launch it into a special guide track around the product to be packed, and then recover it—after its leading end has been blocked or clamped—so as to wind it around the product with a preset tension. Further means then provide to tie and cut the strap after its windup.

It is also known that the modern packing technique requires, on one hand, short operating times and thus high strap launching and recovery speeds and, on the other hand, the possibility to regulate the tensioning of the strap to a wide extent, these two requirements often being scarcely compatible.

2. Description of the Prior Art

A strapping machine which tries to satisfy these requirements is described, for example, in the Italian Patent No. 1,135,722, filed on Mar. 24, 1981, by the same Applicant, to which reference is made herein for a better understanding of the present invention. This machine has turned out to be more than satisfactory for many years, but it is no longer able to fully satisfy the present requirements of packing speed.

One of the problems arising with the increase of the strap feeding speed is to obtain its instant and prompt stopping at the end of the launching stroke and, respectively, at the end of the recovery stroke.

Especially during fast recovery of the strap, the inertia of the machine parts and thus the effect of residual drag of the strap resulting therefrom, causes an undesired tightening thereof around the product to be packed, at a tension higher than that expected, which may often cause damage to said product.

These problems have already been solved in the strapping machine described in the Italian Patent Application No. MI92A 002957 filed on 23rd Dec. 1992, and in the EP-Al-0603868 filed on 22nd Dec. 1993, both in the name of the same Applicant. This strapping machine provides very high performances with a perfectly regular and very precise working, but it also involves very high production costs.

Other strapping machines are known from DE-4014307, U.S. Pat. No. 3,526,187, U.S. Pat. No. 5,379,576 and U.S. Pat. No. 4,516,488.

SUMMARY OF THE INVENTION

The object of the present invention is to thus realize a strapping machine which enables, with a simpler and more economic structure, to perfectly control the tensioning of the strap, during its recovery, and then the stopping thereof, so that the packed product may be fastened with a perfectly registered tightening.

BRIEF DESCRIPTION OF THE DRAWINGS

Further characteristics and advantages of the strapping machine according to the invention will anyhow be more evident from the following detailed description of a preferred embodiment thereof, given by way of example and illustrated on the accompanying drawings, in which.

DESCRIPTION OF THE PREFERRED EMBODIMENT

Figure 1:
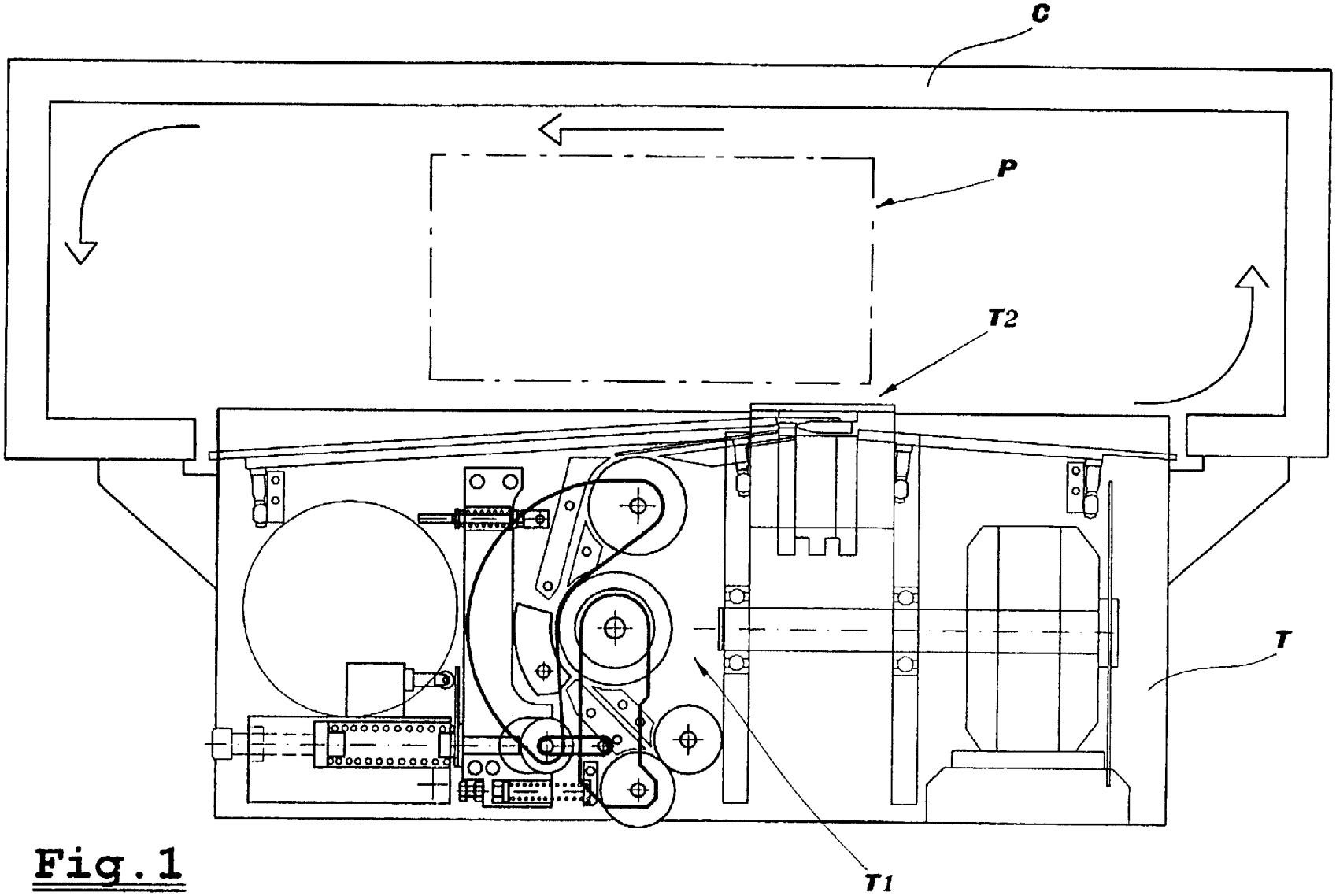
FIG. 1 shows, very diagrammatically, a strapping machine according to the invention.

As shown diagrammatically in FIG. 1, a strapping machine generally comprises a guiding channel C for the strap, forming a closed-ring path—through which is moved the product P to be fastened (shown only by a dash-and-dot line)—and a strapping head T, which mainly includes a strap driving unit T1 (to launch the strap along the path C and recover the same) and a strap welding unit T2 to weld the ends of the strap.

The working of a machine of this type includes—as described more clearly in the patents cited further above—the following steps: a strap launching step, in which the strap is caused to pass through the welding unit T2, and slides along the channel C (for example, in the anticlockwise direction indicated by the arrows in FIG. 1) up to reaching again the welding unit T2; at this point, the end of the strap is temporarily blocked by a gripper; a strap recovery step then starts and continues until the strap has been properly tightened around the product P; the final step consists in welding the two ends of the strap and in cutting the same.

Figure 2:
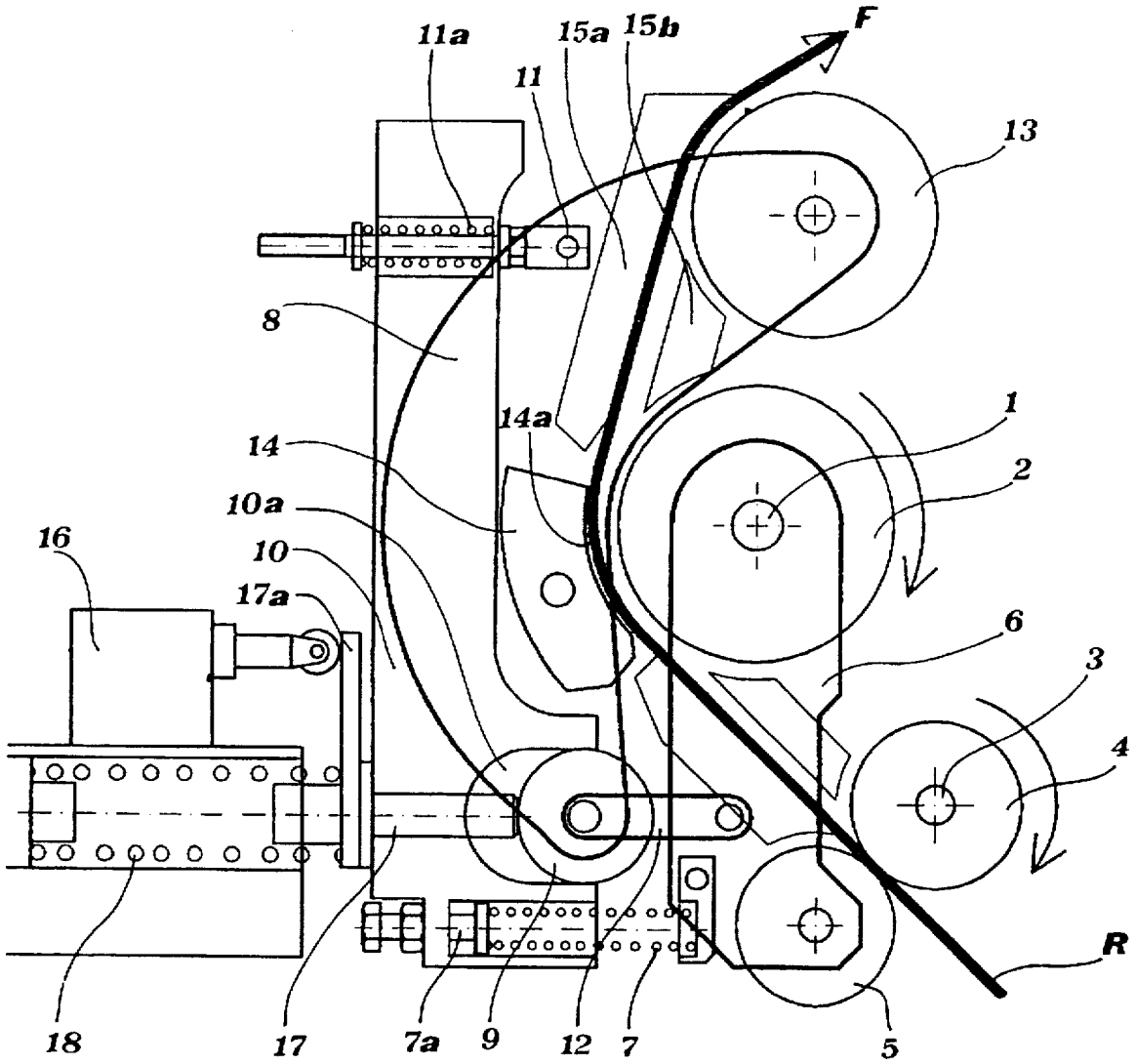
FIG. 2 shows the strap driving unit of the strapping machine, during launching of the strap.

In particular, the object of the invention is the strap launching and recovery unit T1 which, as pointed out further above, forms the most critical part of the machine. According to the invention, and as shown in FIG. 2, said unit comprises a drive shaft 1, rotating clockwise at low speed—hereinafter, the clockwise direction will be that indicated by the rotation arrow referring to the shaft 1 in FIG. 2—and being active during slow recovery of the strap. On the drive shaft 1 there is mounted a driving wheel 2, by way of a so-called "freewheel" mechanism, which allows to draw the strap only in an anticlockwise direction.

Figure 3:
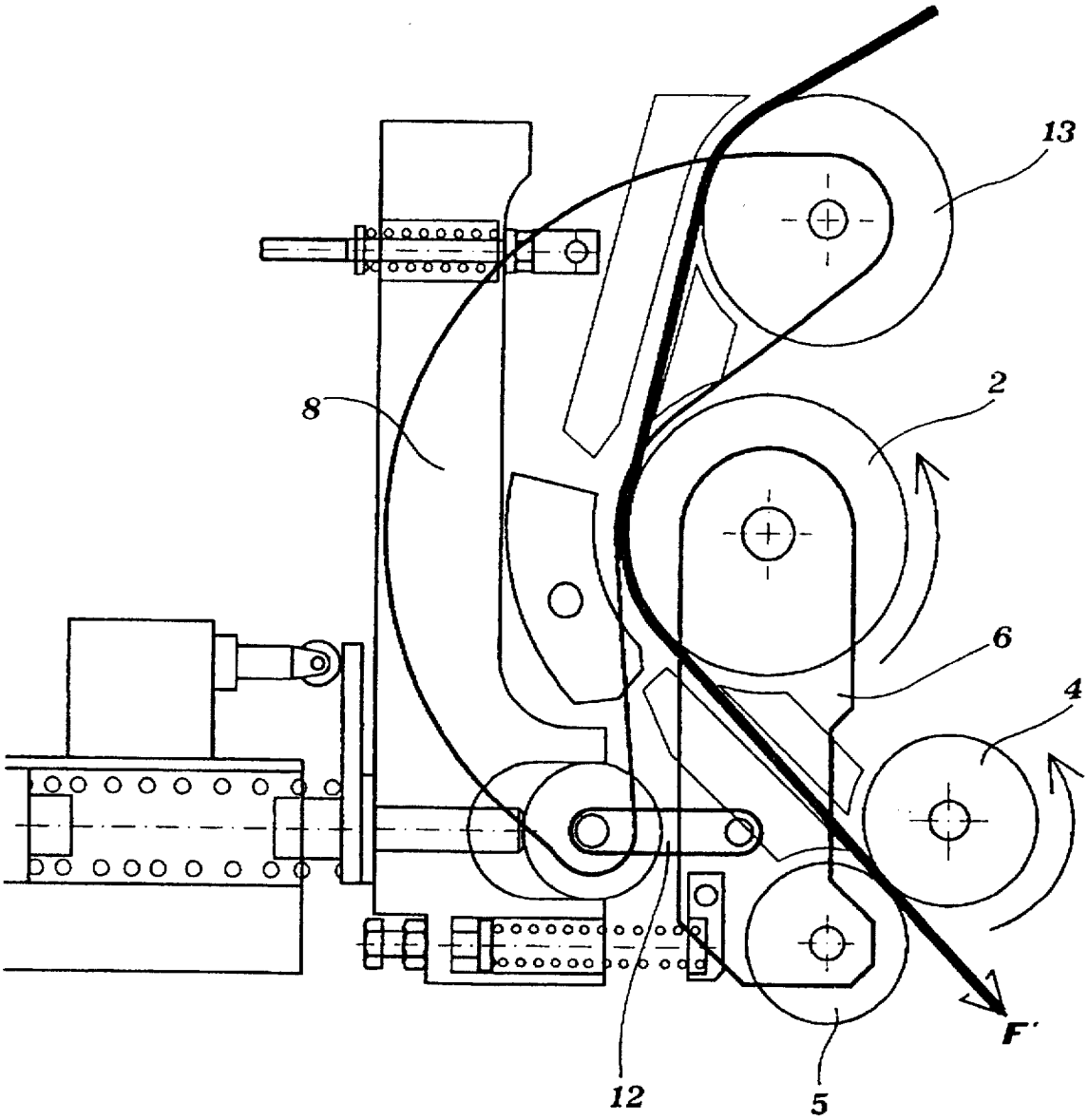
FIG. 3 shows the same unit of FIG. 2, during fast recovery of the strap.
Figure 4:
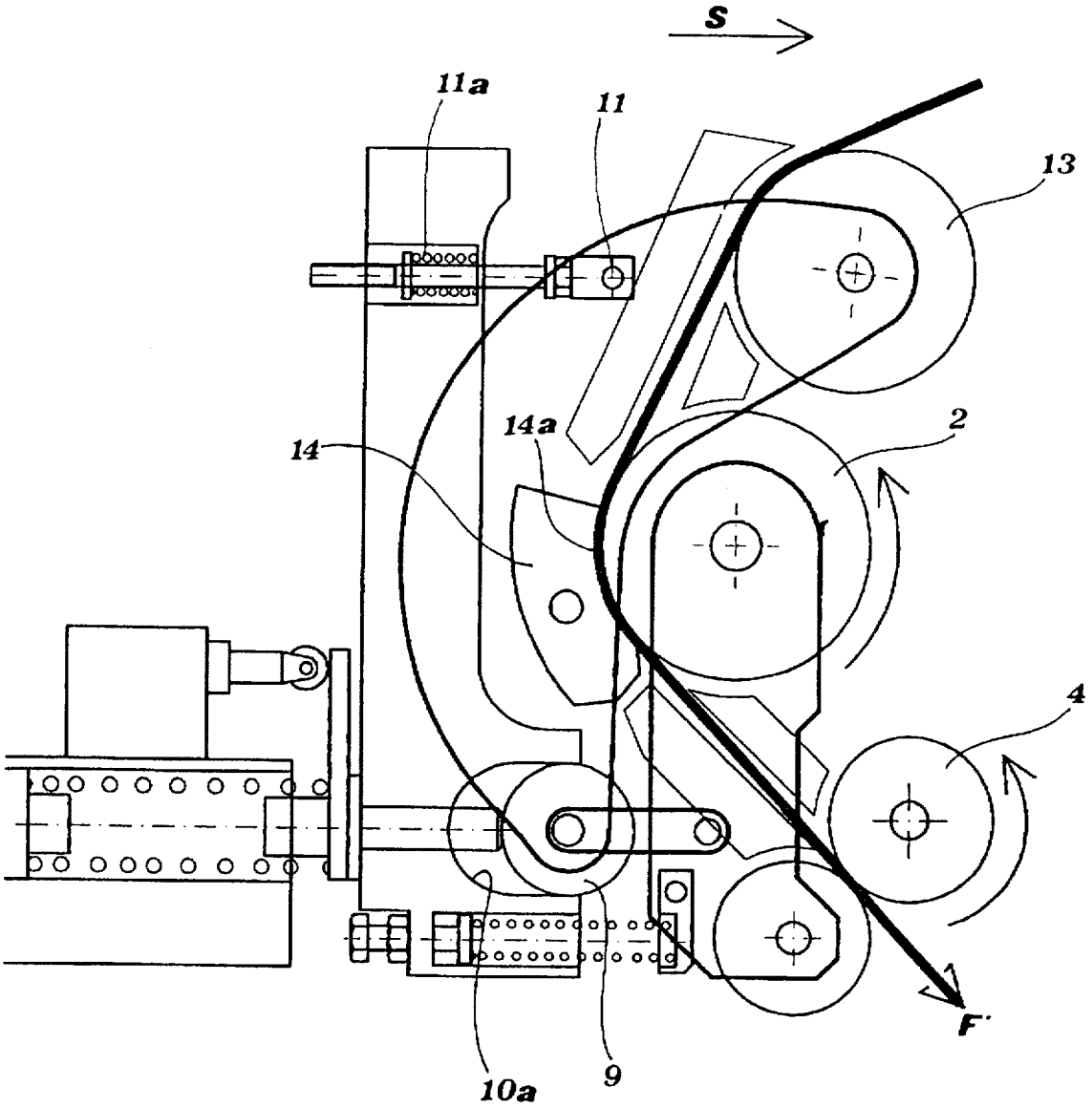
FIG. 4 shows the same driving unit, during the speed-changing steps.

A second drive shaft 3 is rotated at high speed and carries, keyed thereon, a fast driving wheel 4; said shaft 3 is active both during the launching step, with a clockwise rotation (see arrow in FIG. 2), and during the fast recovery step, with an anticlockwise rotation (see arrow in FIGS. 3 and 4).

Preferably, the shafts 1 and 3 are driven by a single motor, which drives the shaft 1 through a reduction gear, and thus at low speed but with a high drawing force, and which directly drives the shaft 3, whose wheel 4 rotates at high speed but with less drawing force.

A pressure wheel 5 cooperates moreover with the driving wheel 4, to ensure drawing of the strap R interposed between said wheels.

The pressure wheel 5 is mounted freely rotating on a shaft supported by an arm 6 which is mounted oscillating on the same axis of the shaft 1; a spring 7 imparts onto the arm 6 a thrust, which can be regulated by way of an adjusting element 7*a*, and which determines the pressure of the wheel 5 against the wheel 4.

To the side of the arm 6 and of the wheel 2 there is mounted oscillating an arched sector 8; said oscillation is obtained (between two guiding sides, not shown), on one side, by pivoting the lower end of the sector 8 onto the axis of a roller 9, which is in turn guided so as to slide horizontalwise into a groove 10*a* of a fixed support 10 of the unit T1, and on the other side, by anchoring the upper end of the sector 8 onto a bracket 11, also sliding horizontally along the support 10, in opposition to the spring 11*a*. A link rod 12 forms an articulated connection between the axis of the roller 9 and the oscillating arm 6.

A transmission wheel 13 is mounted freely rotating at the upper end of the sector 8. Furthermore, substantially at the center of the sector 8 there is fixed a pressure pad 14, whose arc-shaped surface 14*a* is centered on the axis of the shaft 1 and thus runs parallel to the periphery of the wheel 2; the surface 14*a* facing the wheel 2 is perfectly smooth, to act as an anti-friction surface for the purpose better specified hereunder. A guide 15*a*–15*b*, is moreover fixed to the sector 8 for the function indicated hereinafter.

Finally, a microswitch 16 is mounted on the fixed support 10, said microswitch being operated by a rod 17, 17*a*, moved by the roller 9 in opposition to the adjustable spring 18.

Figure 5:
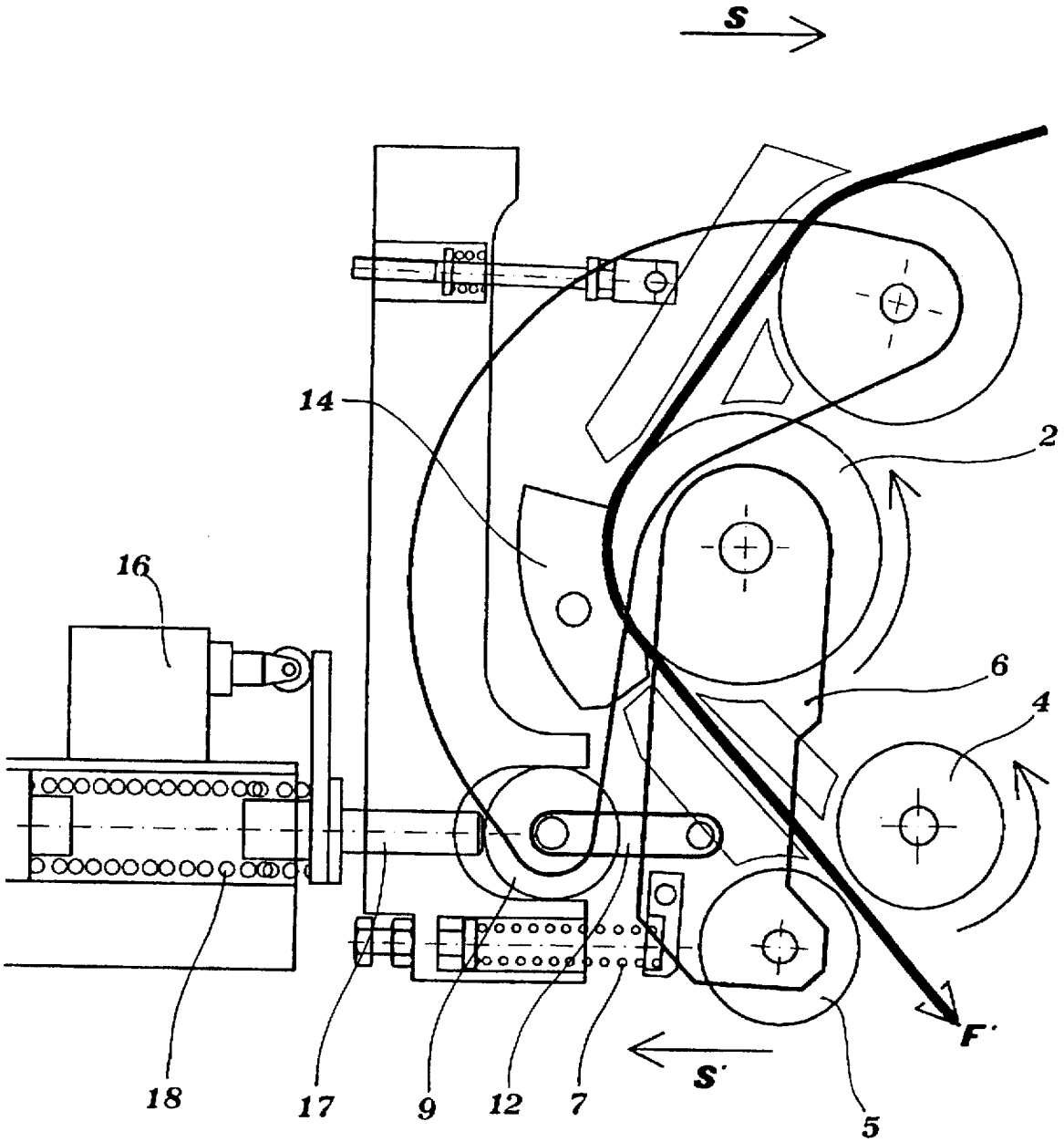
FIG. 5 shows the same driving unit, during slow recovery, that is, during tightening of the strap around the product being packed.

The aforedescribed strapping head works as follows:

a) During the launching step (FIG. 2), the strap R—driven by the wheels 4 and 5—is drawn in the direction of the arrow F towards the surface 14*a* of the pressure pad 14 fixed to the sector 8; from here, it is deviated towards the guide 15*a*–15*b* and then towards the channel C (FIG. 1), in a substantially known manner. During this step, the strap always remains properly spaced both from the wheel 2 and from the wheel 13.

b) During the fast recovery step (FIG. 3), the strap R—still driven by the wheels 4 and 5, but this time in a direction F' opposite to the previous one—gets in contact with the wheels 2 and 13, which are driven into a fast rotation due to friction of the strap R. Thanks to the freewheel mechanism, the wheel 2 is able to rotate at high speed, even if its shaft 1 rotates at low speed.

c) During the speed-changing step, followed by slow tightening, that is, at the moment in which the strap starts to get in contact with the surface of the product having to be fastened, it is almost stopped against the product to be packed and it instantly becomes tensioned; by reaction, this produces a pressure on the only yielding surface, which is the wheel 13, causing this latter to move in the direction of the arrow S (FIG. 4) and thereby causing the clockwise oscillation of the sector 8. One may easily imagine a sequence wherein:

to start with, a very slight clockwise oscillation of the sector 8 is produced about the fulcrum formed by the axis of the roller 9, with compression of the spring 11*a*, until the surface 14*a* of the pad 14 bears against the periphery of the wheel 2. This produces the only effect to guarantee a perfect coupling between the strap R and the surface of the wheel 2, seen that the strap—which still moves fast, driven by the wheels 4 and 5—is free to slide against the smooth surface 14*a*, with no friction, while it clings onto the friction surface of the wheel 2. The leg oscillation—as can be easily understood—is very slight since, as the wheel 13 moves further in the direction S, under the pressure of the strap which is tightening around the product P to be fastened, a stronger oscillation is produced just after; in fact, as shown in FIG. 5, as the pad 14 presses against the wheel 2, the sector 8 rotates about a new fulcrum formed by the actual pad 14. This leads the roller 9 to slide in a direction S', always guided into the groove 10*a*, and to thus also draw the oscillating arm 6 by way of the link rod 12, against the section of the spring 7, into a clockwise rotation (arrow S') which leads the wheel 5 to move apart from the driving wheel 4. As the pressure wheel 5 moves away from the wheel 4, the drawing action on this latter ceases, while the pad 14 simultaneously keeps the strap R always perfectly adherent to the wheel 2; this latter, which is now driven by the shaft 1 through the operative freewheel mechanism, draws the strap at low speed up to tightening the product P with the desired strength;

said strength is regulated by adjusting the resistance opposed by the spring 7 and by the contrast spring 18 of the microswitch 16; in fact, as said resistance is overcome, the sector 8 further oscillates in a clockwise direction, always about the fulcrum formed by the pad 14, causing the roller 9 to move backward and press the rod 17–17*a*, which controls the closing of the microswitch and thereby stops the working of the machine.

It is appropriate to place in evidence a further important advantage of the control device according to the invention, determined by the fact that the strap path on the driving and transmission wheels is fairly "smooth"; in other words, the strap is not forced—as it happens instead in prior art, especially U.S. Pat. No. 4,516,488 and U.S. Pat. No. 5,379,576—to follow arc-shaped paths developing through wide angles, which normally create the inconvenience that, in the event of a prolonged stop, the strap remains permanently deformed, with subsequent risk of jamming when the machine starts working again.

Another considerable advantage lies in the fact that the rotation axes of the wheels 2 and 4 are fixed, whereby the motors driving the shafts 1 and 3 do not have to be mounted on oscillating or otherwise movable structures, to the full advantage of structural simplicity.

It is anyhow understood that the invention is not limited to the particular embodiment described heretofore, which merely forms a non-limiting example of its scope, but that many modifications can be introduced, all within reach of a technician skilled in the art, without thereby departing from the protection scope of the present invention.

I claim:

1. Device for controlling the feeding of a strap in a strapping machine, the device comprising:

at least one fast driving wheel and one slow driving wheel;

each wheel having a periphery for guiding the strap thereon;

said fast driving wheel and said slow driving wheel being mounted on fixed axes and rotated by respective drive shafts which are always active;

said slow driving wheel being mounted on the respective drive shaft through a freewheel mechanism;

pressure means for pressing the strap against the periphery of at least one of said driving wheels so as to insure feeding thereof;

said pressure means being moved by an oscillating member operating in response to tensioning of the strap;

said pressure means comprising a first and a second pressure element mounted on said oscillating member;

a strap transmission wheel mounted on said oscillating member and located at a distance from said pressure elements to form an angle of deviation of the strap path, whereby during a recovery step, the strap contacts the fast driving wheel, and tensioning of the strap causes, by action on the transmission wheel, the member to oscillate and transfer the contact pressure of the strap from the fast driving wheel onto the slow driving wheel, merely through an alternative action of said pressure elements.

2. Control device according to claim 1, wherein said first pressure element comprises a pressure wheel mounted freely rotating on a movable shaft.

3. Control device according to claim 1, wherein said shaft of the pressure wheel is supported by an arm mounted oscillating about the fixed axis of the slow driving wheel.

4. Control device according to claim 3, comprising adjustable spring pressure means, acting on the oscillating arm so as to determine the drawing pressure of the pressure wheel.

5. Control device according to claim 4, wherein said oscillating arm is connected to said oscillating member via an articulated link rod.

6. Control device according to claim 5, wherein said oscillating member is arched, has two ends, and pivots about a first end articulated on said link rod, onto the axis of a sliding roller, which is slideable along a fixed guide groove.

7. Control device according to claim 6, wherein said fixed guide groove comprises stopping means cooperating with said sliding roller at the end of its travel.

8. Control device according to claim 7, wherein said stopping means comprise a microswitch, a rod, and an adjustable spring element.

9. Control device according to claim 1, wherein said second pressure element comprises a pressure pad fixed on said oscillating member.

10. Control device according to claim 9, wherein said pressure pad has an arch-shaped surface, concentric and parallel to the peripheral surface of the slow driving wheel, and has a low coefficient of friction.

11. Control device according to claim 6, wherein said transmission wheel is mounted freely rotating at the second end of said oscillating member opposite to the end articulated on said link rod.

* * * * *

UNITED STATES PATENT AND TRADEMARK OFFICE

CERTIFICATE OF CORRECTION

PATENT NO. : 5,778,643

DATED : July 14, 1998

INVENTOR(S) : Franco TACCHINI

It is certified that error appears in the above-indentified patent and that said Letters Patent is hereby corrected as shown below:

On the title page, insert Item [30] as follows:

--[30] Foreign Application Priority Data

March 14, 1996 [IT] Italy.....MI96A000489--.

Signed and Sealed this

Seventh Day of September, 1999

*Attest:*

Q. TODD DICKINSON

*Attesting Officer*

*Acting Commissioner of Patents and Trademarks*